United States Patent [19]

Laus

[11] 4,147,507

[45] Apr. 3, 1979

[54] PRODUCTION OF COLORED PATTERNS ON NAP FABRICS

[75] Inventor: Heinrich Laus, Grefrath-Oedt, Fed. Rep. of Germany

[73] Assignee: Girmes-Werke AG, Grefrath-Oedt, Fed. Rep. of Germany

[21] Appl. No.: 843,808

[22] Filed: Oct. 20, 1977

Related U.S. Application Data

[63] Continuation of Ser. No. 625,898, Oct. 28, 1975, abandoned.

[30] Foreign Application Priority Data

Oct. 31, 1974 [DE] Fed. Rep. of Germany ..... 2451806

[51] Int. Cl.[2] ..... D06P 7/00

[52] U.S. Cl. ..... 8/1 XB; 8/14; 8/17; 8/21 A; 8/176; 8/177 R

[58] Field of Search ..... 8/1 XB, 14, 17, 21 A, 8/176

[56] References Cited

U.S. PATENT DOCUMENTS 1,557,461 10/1925 Lauten ..... 8/14

FOREIGN PATENT DOCUMENTS 381964 10/1932 United Kingdom ..... 8/1 XB

OTHER PUBLICATIONS

Textile Chemistry, vol. III, The Physical Chemistry of Dyeing; R. H. Peters, 1975, pp. 107, 108.

*Primary Examiner*—John Kight, III

[57] ABSTRACT

A method of producing colored patterns on the nap of nap fabrics, in which the nap is subjected briefly to pressure and heat to modify the absorption capacity of synthetic filaments or fibers wholly or partly making up the nap, after which the fabric is dyed in a conventional manner.

2 Claims, 9 Drawing Figures

PRODUCTION OF COLORED PATTERNS ON NAP FABRICS

This is a continuation, of application Ser. No. 625,898, filed Oct. 28, 1975, now abandoned.

BACKGROUND OF THE INVENTION

Various techniques are already known for producing coloured patterns or designs on nap or pile fabrics. Thus, for example, the Jacquard weaving process may be employed to interweave different yarns or undyed yarns have differing affinities for dyes subsequently applied, so that a two-tone effect is produced during the dyeing stage.

It is also possible for two-tone effects to be produced by printing nap fabrics with paste dye with or without the addition of chemical swelling agents. Also a previously dyed nap fabric, having a nap consisting of acrylic fibers, may be printed with contrast-forming agents such as ethylene carbonate or propylene carbonate, the fabric being subjected after drying to an electropolishing process.

These known methods for giving a nap fabric a two-tone effect are however very unsatisfactory from the practical point of view, being time consuming and requiring expensive equipment.

SUMMARY OF THE INVENTION

An object of this invention is to provide a process for the production of coloured patterns or designs on nap or pile fabrics, which is technically simple.

A further object of the invention is to provide a dyed nap fabric having a two-tone pattern thereon.

The invention is based upon my discovery that nap fabric piece goods, which have a nap consisting entirely or partly of synthetic filaments or synthetic fibers such as acrylic and/or modacrylic filaments or fibers may be caused to absorb dye in a non-uniform manner if selected regions are previously subjected to pressure and heat. This effect stems from the fact that the absorption capacity of the fibrous nap of the nap surface for dyes diminishes drastically in the selected regions.

Accordingly, the invention provides a process in which the nap of the nap fabric is subjected briefly to pressure and heat before dyeing, in a manner which modifies the affinity to dye of the synthetic fibers or filaments, after which the nap fabric is dyed and finished in the usual manner. In consequence the nap may be so pretreated, before dyeing, that its fibers absorb dyes in a differential manner according to a predetermined design, whereby decorative coloured patterns, such as a figurative two-tone effect, form during the subsequent dyeing of the nap fabrics. The dyeing operation may be performed as piece dyeing, for example, and subsequent final finishing may be carried out in the conventional manner.

In order to restrict the heat and pressure treatment of the nap surface to preselected regions in accordance with the design to be produced, use is preferably made of a metal cylinder or roll which can be heated to a precise temperature and has a relief-like engraved surface. This metal cylinder may with advantage revolve between two counter-rolls having smooth surfaces, namely an upper pressing roll and a lower counter-roll. Preferably, the overall roll unit is equipped with devices for finely regulating the pressure applied to the fabric to be treated as well as the temperature of the cylinder. In this way, the pattern to be produced on the nap fabric can be regulated between wide limits.

In the case of a fibrous nap made up from acrylic or modacrylic fibers, the temperature of the metal cylinder is preferably between about 170° and 190° C. The actual temperature depends upon the density of the fabric, that is the weight per square meter of the fibrous nap of the nap fabric. An easily modified fabric may be processed at a lower temperature and may also be subjected to a lower pressure by the cylinders. This pressure may be between about 1 to 5 kg/cm$^2$, and its magnitude depends on the density of the fibrous nap. If the fibrous nap contains fibers of non-acrylic materials, such as polyamide fibers or polyester fibers, then the operation should be carried out at a temperature in the range of 190° C. to the 210° C. and a pressure of 1 to 5 kg/cm$^2$. Advantageously, the treated fabric is passed through the nip of the metal cylinders which carry out the heat and pressure treatment at a rate of between 2 and 5 meters per minute.

The coloured pattern or designs produced in accordance with the invention do not depend upon the reflective characteristics of the fibers in such a way that a bright/dark effect is produced in accordance with varying positions of the nap or curvature of the fibers. Neither is reliance placed on parts of the surface being permanently in relief, although a relief-effect is present in the partly treated product. After the dyeing process, the product of the present invention is subjected to a conventional dressing treatment, that is, it is squeezed in hot water, napped, beaten, dried and/or sheared. After such final finishing, the nap surface regains its level, unrelieved form, and exhibits only the desired decorative coloured patterning, for example two-tone effects. In addition, the portions of the nap surface of the nap fabric which have remained light in colour, that is those portions which were subjected to pressure and heat before dyeing and had their affinity for dyes modified, exhibit a pleasant coloured pattern, which may be similar to a Batik effect. This phenomenon is attributable to the fact that a three-dimensional flat structure such as a nap fabric responds to mechanical pressure in a somewhat elastic fashion and, when the invention is carried into effect in practice, the pressure and heat do not act absolutely uniformly on the nap surface. Instead, differences which cannot be accurately predetermined occur, which result in an especially interesting random pattern in the end product.

A preferred material for the nap surface comprises acrylic and/or modacrylic filaments or fibers, such as those sold under the Trade Marks Dralon, Dolan and Verel, for example. The rear face of the nap fabric may consist, for example, of a woven fabric having warp and weft of cotton yarn or cotton mixed yarn, such as cotton-polyester mixed yarn, or again of pure polyester yarn. Other synthetic fibres or synthetic filaments such as polyester fibres or polyamide fibres may also be used for the nap surface of the nap fabric.

The temperature of the cylinder used to subject the fabric to heat and pressure is determined empirically for the particular type of fiber used, as is the pressure applied by the cylinder to the fabric. The temperature of the cylinder which has an engraved peripheral surface should desirably be about 185° C. in the case of a pile fabric having a weight per square meter of 300–600g and containing acrylic fibres as the nap material. The pressure which the cylinder applies to the nap surface of such a fabric should be about 3kg/cm$^2$. The fabric should be passed at a speed of between 2 and 5 meters per minute beneath the cylinder and through the roll unit in which it is included. The acrylic fibers of the pile surface may contain, in this example, at least 85% of polymerized acrylonitrile.

Nap goods pre-treated using the process provided by this invention with heat and pressure may be dyed using the usual piece dyeing techniques, for example with the aid of a spool pad, or by means of a continuously operating dyeing machine or by star dyeing utilising the usual cationic dyes for acrylic fibres.

If the nap surface of the nap fibric contains fibers of non-acrylic materials such as polyamide or polyester fibers, then the dyes usually employed to treat such fibers (such as anionic dyes or dispersion dyes) should be utilised for the dyeing operation.

Nap fabric or nap goods in the context of this specification are to be understood to include three-dimensional flat structures possessing a fibrous nap and produced by the known techniques of weaving, knitting, crocheting, tufting or stitching, for example. Nap materials are understood to include pile materials of all types, the pile or pile surface of which possesses an affinity for dyes which can be varied in accordance with this invention.

In the claims hereof, the expression "synthetic fibers" includes synthetic filaments, and "acrylic" fibers includes modacrylic fibers.

DESCRIPTION OF PREFERRED EMBODIMENTS

Figures 1, 2:
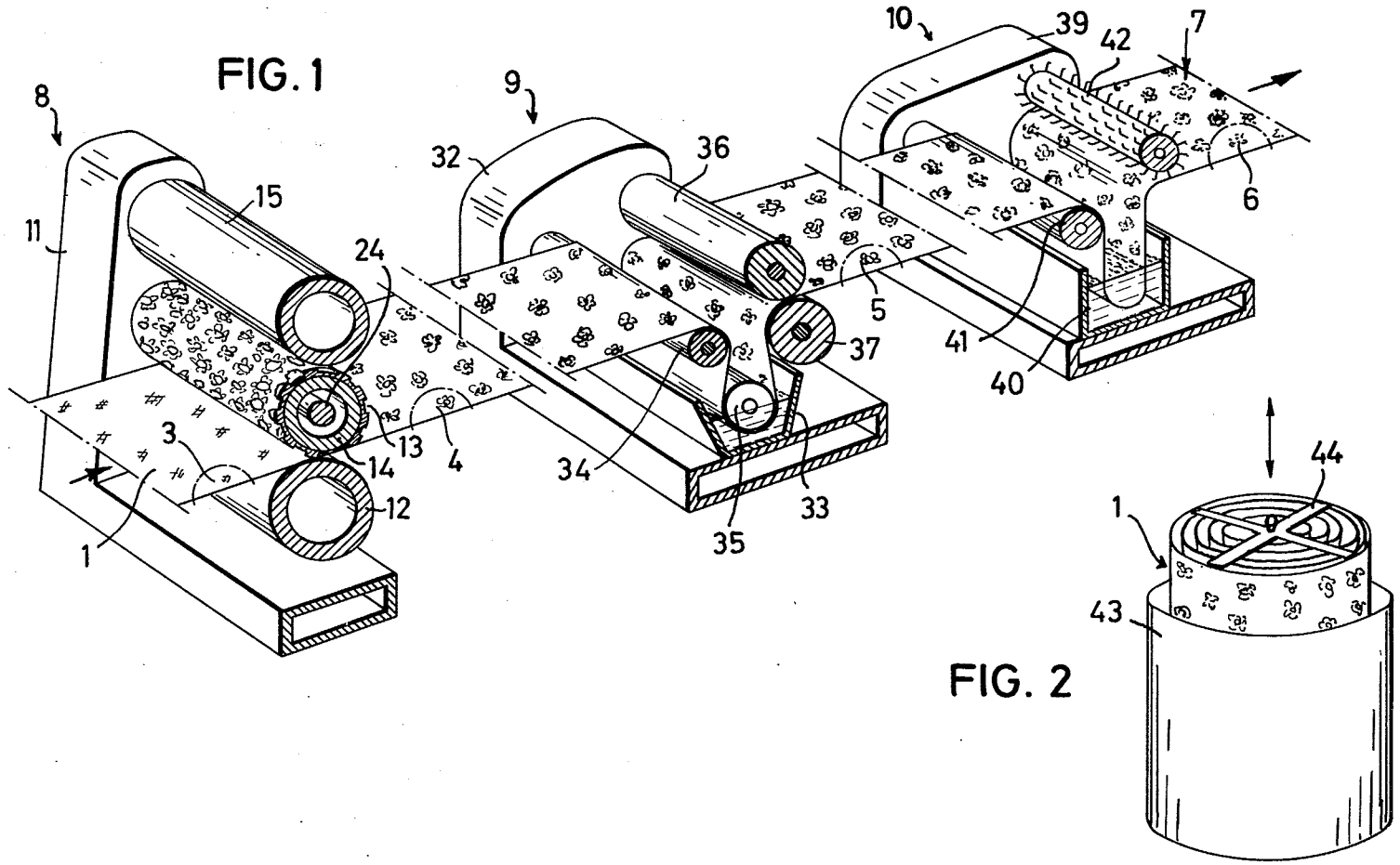
FIG. 1 is a perspective, diagrammatic view of a continuously operating plant for producing a pattern upon the nap of a web of nap fabric.
FIG. 2 is a perspective view of a container for the piece dyeing of a pretreated nap fabric web.
Figure 7:
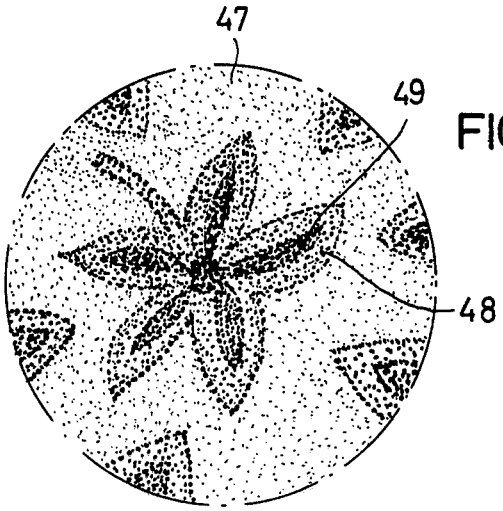
FIG. 7 is a plan view of a fragment of the web, taken in the direction of arrow 7 in FIG. 1.
Figure 8:
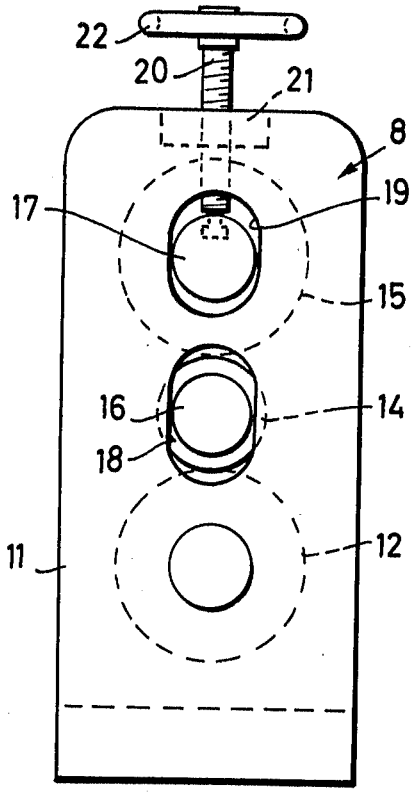
FIG. 8 shows one of the end supports of the roll stand in which the engraved cylinder is supported showing the mechanism for finely adjusting the pressure exerted upon the nap fabric web.

Referring to FIG. 1, a nap fabric web 1 is fed continuously through a roll unit 8, a dyeing unit 9 and a after-treatment device 10. The web 1 enters the roll stand 8 undyed and, after being treated with a single dye in the unit 9, leaves the after-treatment unit 10 as a nap fabric web having a patterned nap as shown in FIG. 7. The roll unit 8 comprises a stand 11 in which is journalled without provision for adjustment a lower or counter-roll 12 over which the web 1 runs. Journalled in the stand above the roll 12 is a cylinder 14 of metal, for example brass, with a relief-like engraved peripheral surface 13. Above the cylinder 14 is journalled a pressing roll 15. The cylinder 14 and pressing roll 15 are journalled in bearing blocks 16, 17 respectively, which are vertically slidable in elongate holes 18, 19, respectively, in side frames of the stand 11, in order to permit the cylinder 14 to be pressed by the pressing roll 15 against the counter-roll 12. The pressure applied to the cylinder is regulated by means of spindles 20, located one on each side of the stand 11, but only one of which is shown in FIG. 8. Each spindle has a screw and is screwed into an internally threaded bore in a block 21, secured to the stand 11. The lower end of each spindle 20 is retained in the bearing block 17, situated at the associated end of the stand, of the pressure roll 15, so that the bearing block 17 is constrained to follow the upward and downward movements of the spindle 20. The spindle 20 is equipped with a hand wheel 22 to enable it to be rotated manually, but it is also possible to drive the spindle by other means, such as a motor, in order to adjust the pressure.

The cylinder 14 is removable from the stand 11, so that it may be replaced with a cylinder having a different diameter and engraved with a different pattern 13 in order to enable nap fabrics possessing various patterns to be produced.

Figure 9:
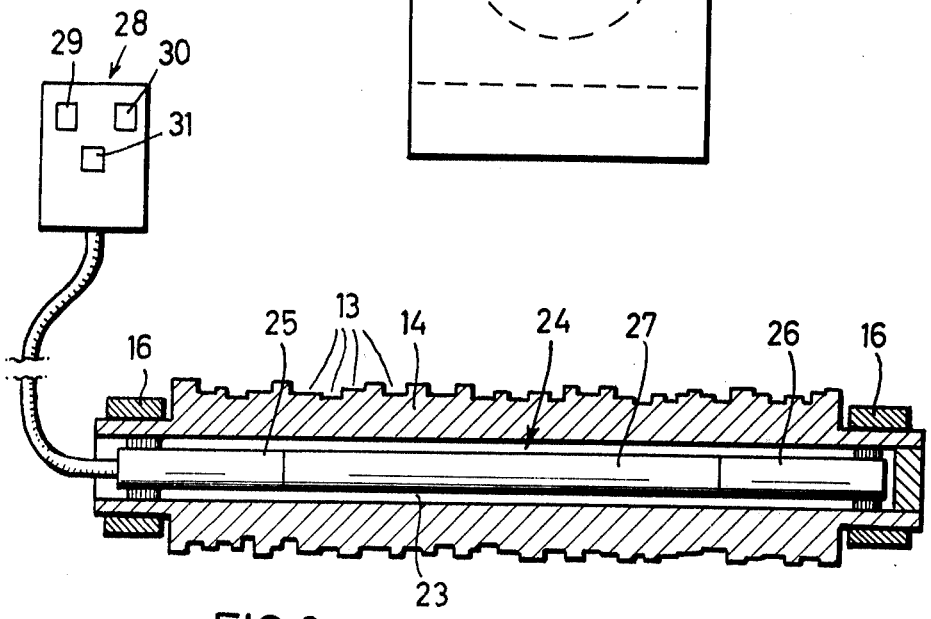
FIG. 9 is an axial section through the engraved cylinder showing a heating bar for heating the cylinder internally.

The cylinder 14 contains a chamber 23, extending right through it, as shown in FIG. 9. A heating element 24, which is subdivided into three sections 25, 26 and 27, is inserted into this chamber 23 from one end, the sections 25 and 26 serving to heat the edge regions and the section 27 the middle region of the cylinder 14. The latter region extends over the greater part of the cylinder. The element 24 is connected to a control box 28 comprising three temperature regulating elements 29, 30 and 31 of know construction, which can be adjusted to set the temperature of the sections 25, 26 and 27 respectively of the heating element. If it is desired to change the cylinder 14, the element 24 is withdrawn first.

The pressing roll 15 and counter-roll 12 have smooth surfaces and therefore cannot damage the engraved surface of the cylinder 14.

The dyeing unit 9 contains, in a frame 32, a container 33 filled with dye, a change-direction roll 34 mounted above the container and an immersion roll 35 journalled in the container 33. Squeezing rolls 36 and 37 are rotatably mounted downstream of the dyeing container 33.

The finishing of the web takes place in the after-treatment device 10 comprising, in a frame 39, a bath 40 above which is located a change-direction roll 41. The web is heated in this bath, and then treated on its surface with a scraper roll 42, in order to lift the dyed fibers of the nap. Opposite to the scraper roll is disposed a counter-roll, not shown, over which the web 1 is led out of the bath 40. Instead of treating a web continuously, as shown in FIG. 1, the dyeing and finishing a web pretreated in the roll stand 8 may be carried out by piece-dyeing in an immersion vessel 43, in which the pretreated web sheet 1 is immersed after being rolled onto a star 44, which is moved up and down in the vessel. The immersion vessel 43 is filled with the desired dye.

Figure 3:
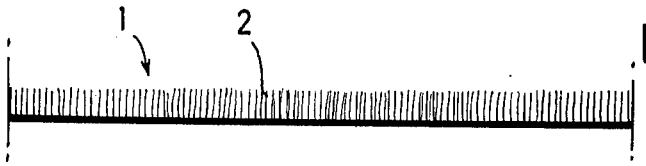
FIGS. 3 to 6 are sections through portions of the web shown in FIG. 1, in the regions 3, 4, 5 and 6 respectively, but to a greatly enlarged scale.
Figure 4:
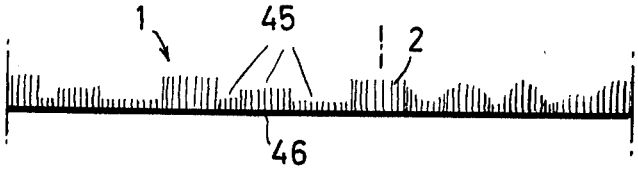

FIGS. 3 to 6 serve to illustrate the individual steps of the treatment. Thus, FIG. 3 shows the pile fabric sheet 1 before any treatment has taken place, so that the pile or nap 2 consists of a large number of thermoplastics synthetic fibers which are of equal length and substantially parallel to one another. FIG. 4 shows the web 1, after its pile 2, has been treated by means of the heated, metal cylinder 14, and has had depressions 45 produced in it, in accordance with the engraved pattern 13 of the cylinder 14. In the drawing, these depressions have been illustrated by a shortening of the separate fibers, but in reality the fibers have been pressed down by differing amounts onto the base weave 46.

Figure 5:
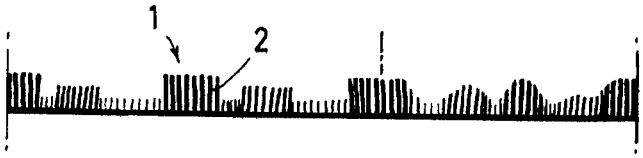
Figure 6:
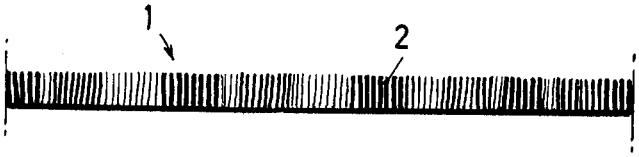

FIG. 5 shows the pile fabric 1, after it has been dyed in a dye bath. It can be seen that the fibers of the pile 2 have absorbed the dye by differing amounts, depending upon how intensely these fibers have been pressed down by the engraved cylinder 14, that is the more intensely pressed-down fibers absorb less dye than those pressed down to a lesser extent or those other fibers which have not been pressed down at all.

After the final finishing of the goods, where again heat is used and thus the thermoplastics fibers of the pile are again heated into the thermoplastic range, the fibers initially pressed down by the cylinder 14 have again been raised, so that the pile 2 again stands up uniformly as in the case of the untreated web shown in FIG. 3. However, the pile 2 now possesses differently dyed zones 47, 48 and 49, the lightest zones 47 being situated where the pile fibers were most pressed down by the cylinder 14, whereas the darkest zones 49 are located where the pile fibers were virtually untouched by the cylinder 14. The zones 48 are situated where the pile fibers have been pressed down to a medium depth.

If the surface of the finished web appears uneven, the web may be subjected to a shearing operation.

What is claimed is:

1. A method for producing a pattern of color intensity variation upon the nap of a nap fabric comprising the steps of:

(a) selecting in a first selecting step, a nap fabric in which the nap is comprised of acrylic material; and (b) selecting in a second selecting step, a desired pattern of color intensity variation for said fabric; the improvement characterized by (c) reducing the dye absorption capacity of portions of said nap by applying pressure within the range of between about 1 and 5 kilograms per square centimeter and heat at a temperature within the range of between about 170° C. and 190° C. to portions thereof according to said second selecting step;

(d) said reducing step being carried out by passing said fabric over a heated metal cylinder engraved according to said second selecting step;

(e) passing said fabric from said first selecting step through a dye bath wherein dye is absorbed according to said second selecting step; and (f) finishing the said dyed fabric in a conventional manner.

2. A nap fabric with a pattern of color intensity variation of the nap thereof, said fabric produced by the method of (a) selecting in a first selecting step, a nap fabric in which the nap is comprised of acrylic material; and (b) selecting in a second selecting step, a desired pattern of color intensity variation for said fabric web; the improvement characterized by (c) reducing the dye absorption capacity of portions of said nap by applying pressure within the range of between about 1 to 5 kilograms per square centimeter and heat at a temperature within the range of between about 170° C. and 190° C. to portions thereof according to said second selecting step;

(d) said reducing step being carried out by passing said fabric over a heated metal cylinder engraved according to said second selecting step;

(e) passing said fabric from said first selecting step through a dye bath wherein dye is absorbed according to said second selecting step; and (f) finishing the said dyed fabric in a conventional manner.

* * * * *